US006854518B1

(12) United States Patent
Senyard, Sr. et al.

(10) Patent No.: US 6,854,518 B1
(45) Date of Patent: Feb. 15, 2005

(54) METHOD AND APPARATUS FOR ENHANCING PRODUCTION FROM AN OIL AND/OR GAS WELL

(76) Inventors: Corley P. Senyard, Sr., 4640 Blue Bell Dr., Baton Rouge, LA (US) 70808; Thomas J. Senyard, Sr., 328 Autumn Oak Dr., Baton Rouge, LA (US) 70810

( * ) Notice: Subject to any disclaimer, the term of this patent is extended or adjusted under 35 U.S.C. 154(b) by 0 days.

(21) Appl. No.: 10/095,424

(22) Filed: Mar. 12, 2002

(51) Int. Cl.[7] ..... E21B 43/18; E21B 43/22

(52) U.S. Cl. ..... 166/372; 166/68; 166/270.1; 166/370

(58) Field of Search ..... 166/300, 369, 166/370, 371, 372, 268, 270.1, 68

(56) References Cited

U.S. PATENT DOCUMENTS 4,323,738 A * 4/1982 Merrick ..... 379/21
4,741,397 A * 5/1988 Weeks ..... 166/250.15
4,844,156 A * 7/1989 Hesh ..... 166/263
5,106,232 A * 4/1992 Metzer et al. ..... 405/128.2
5,400,858 A 3/1995 Blanchard et al. ..... 166/370
5,464,309 A * 11/1995 Mancini et al. ..... 405/128.25
5,509,475 A * 4/1996 Lewis ..... 166/68
5,547,021 A * 8/1996 Raden ..... 166/250.07
5,709,505 A * 1/1998 Williams et al. ..... 405/128.2
5,813,799 A * 9/1998 Calcote et al. ..... 405/128.25
5,906,241 A * 5/1999 Pehlivan et al. ..... 166/372
6,173,768 B1 * 1/2001 Watson ..... 166/68
6,305,473 B1 * 10/2001 Peramaki ..... 166/313
6,352,387 B1 * 3/2002 Briggs et al. ..... 405/128.25
6,367,555 B1 * 4/2002 Senyard et al. ..... 166/370
6,413,016 B1 * 7/2002 Nelson et al. ..... 405/128.35
6,422,313 B1 * 7/2002 Knight ..... 166/267
6,497,281 B2 * 12/2002 Vann ..... 166/250.15

* cited by examiner

*Primary Examiner*—David Bagnell
(74) *Attorney, Agent, or Firm*—Garvey, Smith, Nehrbass & Doody, LLC; Charles C. Garvey, Jr.

(57) ABSTRACT

A method of assisting production of an oil and/or gas well involves reducing the pressure at the top of a well and aid in oil and gas production. If any gas exists in the produced fluid, gas expansion at the resulting reduced pressure will reduce the fluid density in the production pipe, thus further assisting fluid production. If some secondary production enhancement is in use (balance beam, downhole pump, gas lift, surfactant, etc.), this invention will increase the efficiency of the secondary lift. If supplemental gas is introduced anywhere along the production pipe as a "gas lift" method of secondary production, this supplemental gas expansion at the resulting reduced pressure will reduce the fluid density in the production pipe, thus further assisting fluid production. If the pressure reducer is applied to the line pipe carrying the production fluids remote from the wellhead, the reduced pressure will enhance fluid velocity and amount; expanding gas in the fluid at lower pressures in the pipe will increase the flowing velocity of the fluid.

20 Claims, 5 Drawing Sheets

METHOD AND APPARATUS FOR ENHANCING PRODUCTION FROM AN OIL AND/OR GAS WELL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION

1. Field of the Invention

The present invention relates to oil and/or gas well production. More particularly, the present invention relates to an improved method and apparatus for producing oil and gas from a well using a vacuum or pressure reducing system to reduce the pressure at the wellhead and imposes a lower pressure at the oil and/or gas producing formation. This can be applied to wells under secondary production methods to increase the secondary method efficiency. It can also be applied to naturally flowing wells to reduce the pressure in the casing at the producing formation.

2. General Background of the Invention

Two patents have issued that are directed to use of a vacuum pump at the top of the well. The first example of such a system is described in the Blanchard et al. patent, U.S. Pat. No. 5,400,858 entitled "Groundwater Recovery System". This patent describes a system for recovering groundwater from a subterranean aquifer by connecting a vacuum pump at the top of the well tubing. Gas from the annular area mixes through apertures in the tubing with the liquid, thus reducing the density of the flowing liquid and aiding in the lift. The Blanchard patent is focused on groundwater recovery only.

U.S. Pat. No. 5,547,021 issued to Dennis P. Raden and entitled "Method and Apparatus for Fluid Production From a Wellbore" describes a system for assisting in lifting produced hydrocarbon liquid and produced water by means of a vacuum applied to the top of the production tubing; in addition, this method could be supplemented by providing a lift gas fed from another production tubing to the bottom of the well. This lift gas could also be supplied by delivering down the well casing or the casing/tubing annulus. He also claims usage of eductors and valves. The Raden patent claims the vacuum applied at the ground surface is imposed through the tubing string and into the sump at the bottom of the well.

BRIEF SUMMARY OF THE INVENTION

The present invention provides an improved method and apparatus for producing oil and/or gas from a well. The method of the present invention utilizes a pressure reducing system to reduce the pressure at the top of the well. The pressure at the wellhead may be vacuum, atmospheric, or above atmospheric, but must be lower than the pressure which would exist if the pressure reducing means were not applied. This pressure reducing means (eg. pump, eductor, etc.) can be applied locally at the wellhead, or remotely, such as at a centralized tank battery some distance from one or more wells. This pressure reducing means may also be used at any point in the line pipe between the well and a remote location such as a centralized tank battery.

BRIEF DESCRIPTION OF THE DRAWINGS

For a further understanding of the nature, objects, and advantages of the present invention, reference should be made to the following detailed description, read in conjunction with the following drawings, wherein like reference numerals denote like elements and wherein.

DETAILED DESCRIPTION OF THE INVENTION

FIGS. 1–5 are schematic representations for illustrative purposes.

Figure 1:
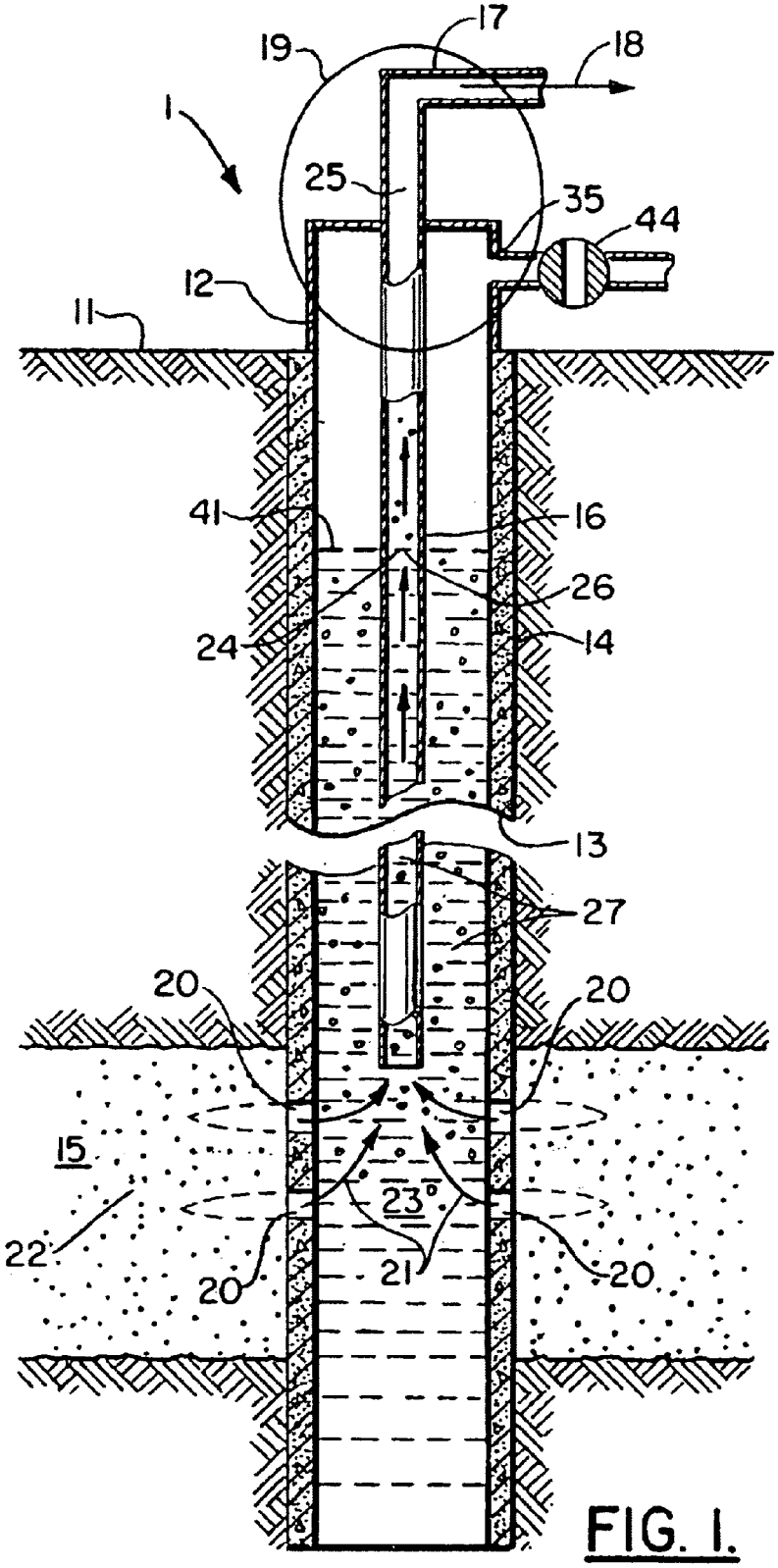
FIG. 1. (PRIOR ART)
FIG. 1 shows a cross section of a typical prior art well, showing the well production pipe partially filled with liquid (oil and/or water)

FIG. 1 shows a prior art type well designated generally by the numeral 1. Well 1 is shown in relation to the earth's surface 11. The well 1 is comprised of a borehole 14 that contains a well casing 12 that can be surrounded by a layer of concrete 13.

By Deep into the earth, production sands 15 produce oil, water, and/or gas via a plurality of well perforations 20. Production pipe 16 is placed inside of casing 12. The production pipe 16 has a lower end portion that extends to a level adjacent production sands 15, as shown in FIG. 1. At this location, perforations 20 cut through casing 12 and its concrete layer 13 enable oil, gas, and/or water to flow under pressure via perforations 20 into production pipe 16.

In FIG. 1, arrows 21 schematically illustrate production flow from production sands 15 into production pipe 16. At the upper end portion of production pipe 16 there is provided a well head 19 comprised of piping and valves that can include a lateral flow line 17 that receives production from production pipe 16 as indicated by arrow 18 as the well produces.

In FIG. 1, various pressure reference points 22–25 are shown. The well in FIG. 1 has a liquid content indicated by the numeral 27. This liquid content 27 can include water and/or oil. This liquid rises to level 26 in production pipe 16.

FIG. 1 thus shows a cross section of a typical well 1, but also showing the well production pipe 16 partially filled with liquid 27 (oil and/or water) having liquid level 26.

The minimum possible pressure drop limiting the production of hydrocarbons from the well is pressure from the production sands (reference numeral 22) to the inside of the well casing (reference numeral 23), plus the pressure drop which would exist between the pressure at 23 and at the wellhead (reference numeral 25), and assuming the production pipe contained only gas with no standing liquid. However, since wells can also have a standing "column of liquid", production is also limited by the additional pressure drop incurred due to the column of liquid 27, calculated as the top of the liquid at level 26 (pressure point reference numeral 24) minus the pressure at 23 inside the well casing.

And in many cases, this additional pressure drop from 24 to 23 is much greater than the minimum possible pressure drop, restricting hydrocarbon production to a mere fraction of what would otherwise be possible. In other cases, the column of liquid rises to a height such that the pressure drop, from 23 to 24 to 25 is greater than or equal to the inherent production sands pressure minus the pressure drop from 22 to 23. In such a case, the well no longer produces hydrocarbons, and the well is said to be "watered up", "flooded", or just "dead".

The present invention provides an improved method and apparatus for increasing hydrocarbon production of a well by reducing the pressure at the wellhead (pressure point reference numeral 25), which in turn reduces the pressures at the top of the liquid at level 26 (pressure point reference numeral 24). This then reduces the pressure at the inside of the bottom of the well casing (reference numeral 23), causing an increase in pressure drop between the pressure from the production sands (reference numeral 22) and the inside of the well casing (reference numeral 23). The end result is higher hydrocarbon production flow. At the same time, the pressure is reduced throughout the production pipe 16, which reduces the density of the column of fluid with content 27. This effect further reduces the pressures in the production pipe 16, until an equilibrium is finally reached.

Figure 2:
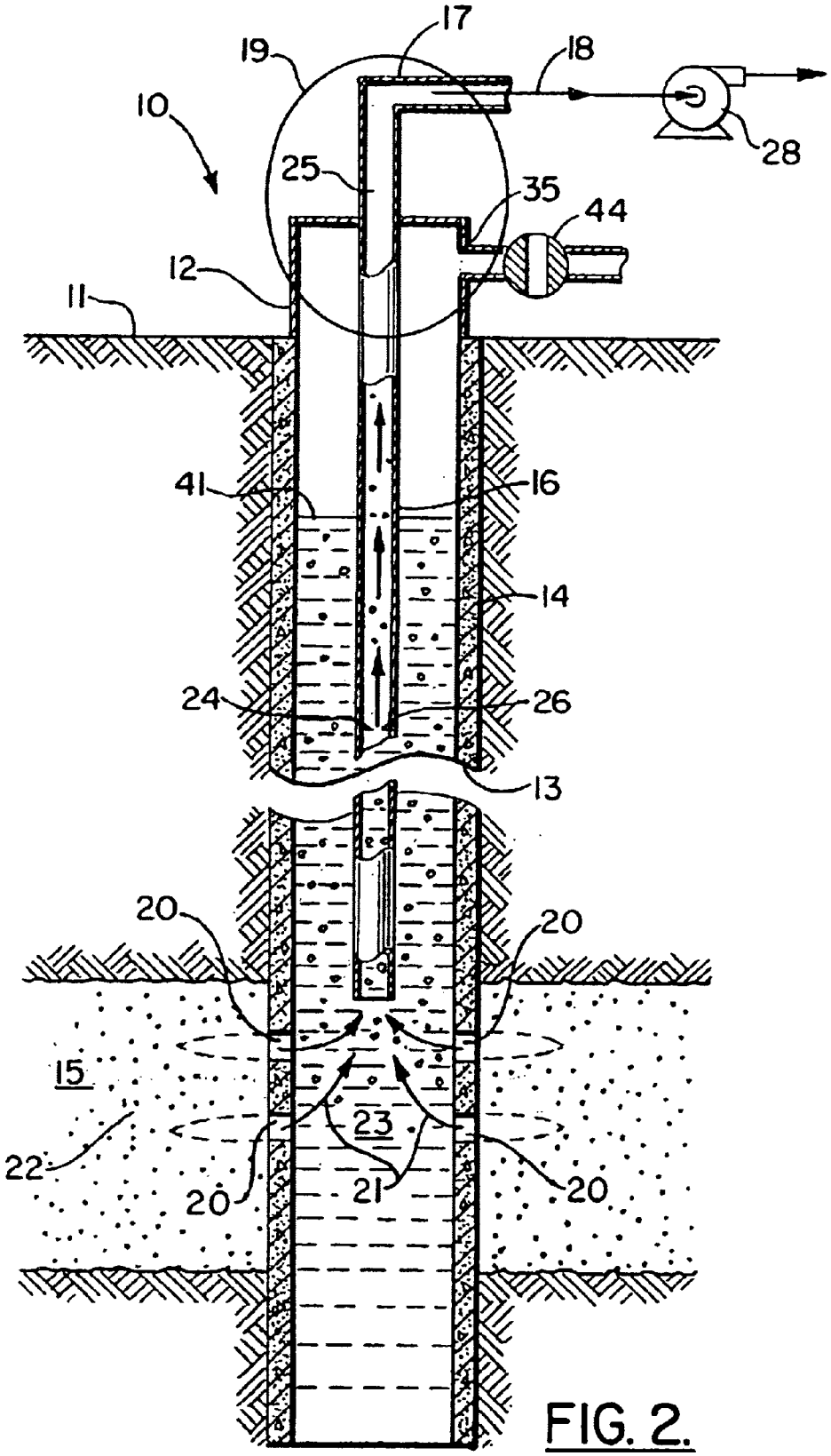
FIG. 2 is a sectional elevation view of a first embodiment of the apparatus of the present invention and showing the method of the present invention.

The apparatus and method of the present invention as shown in FIGS. 2–5, designated generally by the numeral 10. Well 10 in FIGS. 2–5 includes a well casing 12 surrounded by concrete layer 13 in bore hole 14. Wellhead 19 is at the earth's surface 11. Production pipe 16 has lateral flow line 17 at the well head 19. Arrow 18 in FIG. 2 schematically indicates production of oil and gas through lateral flow line 17. Valve 44 on lateral flow line 35 attached to casing 12 is typically closed if the well 10 has no significant gas production, and typically open if the well 10 has significant gas production.

Figure 3:
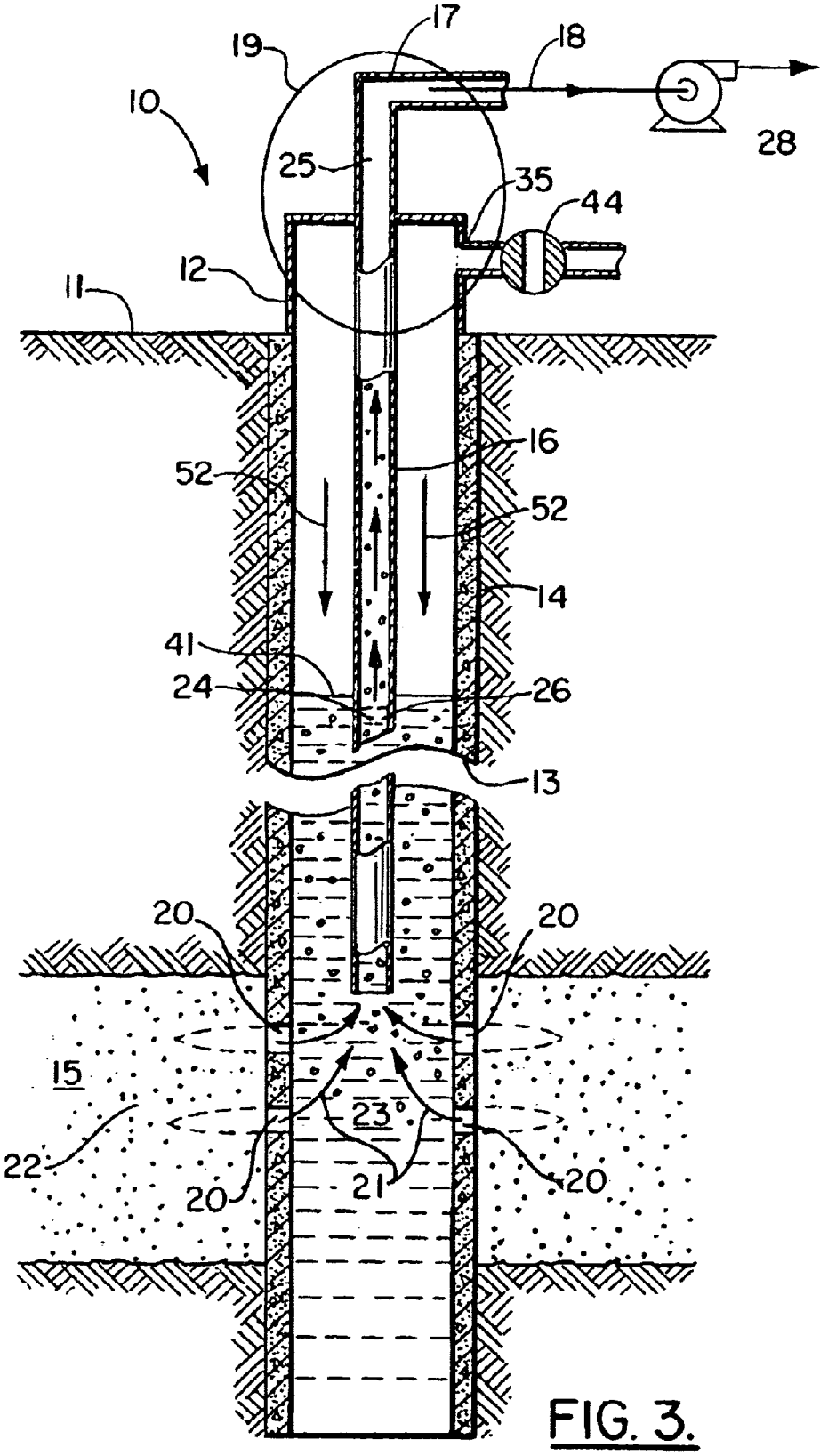
FIG. 3 is another sectional elevation view of the first embodiment of the apparatus of the present invention and showing the method of the present invention.

In the embodiment of FIGS. 2 and 3, a pressure reducing means (eg. pump 28, eductor, etc.) is applied to lateral flow line 17 attached to the production tubing 16, reducing the pressure at the wellhead (pressure point reference numeral 25), which in turn reduces the pressures at the top of the liquid at level 26 (pressure point reference numeral 24).

In FIG. 3, pump 28 has been applied for a period of time to lateral flow line 17 attached to the production tubing 16, and the result is that liquid level 41 in the annulus between the production pipe 16 and the casing 12 has dropped from FIG. 2 to FIG. 3 as indicated by arrows 52. This drop corresponds to an increase in pressure drop between production sands (pressure point reference number 22) and the inside of the well casing (pressure point reference number 23), resulting in an increased production of hydrocarbons.

Figure 4:
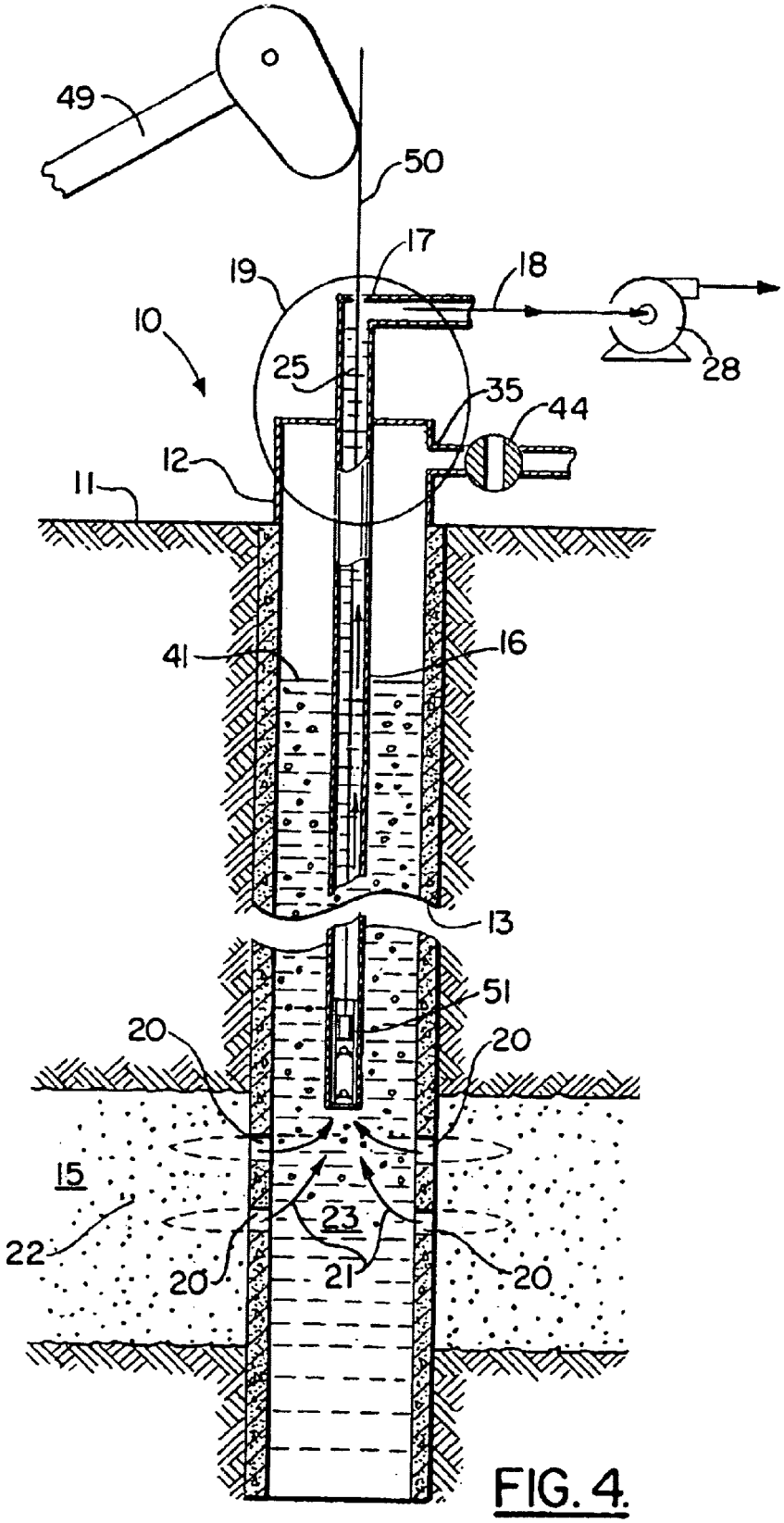
FIG. 4 is a sectional elevation view of a second embodiment of the apparatus of the present invention and showing the method of the present invention.
Figure 5:
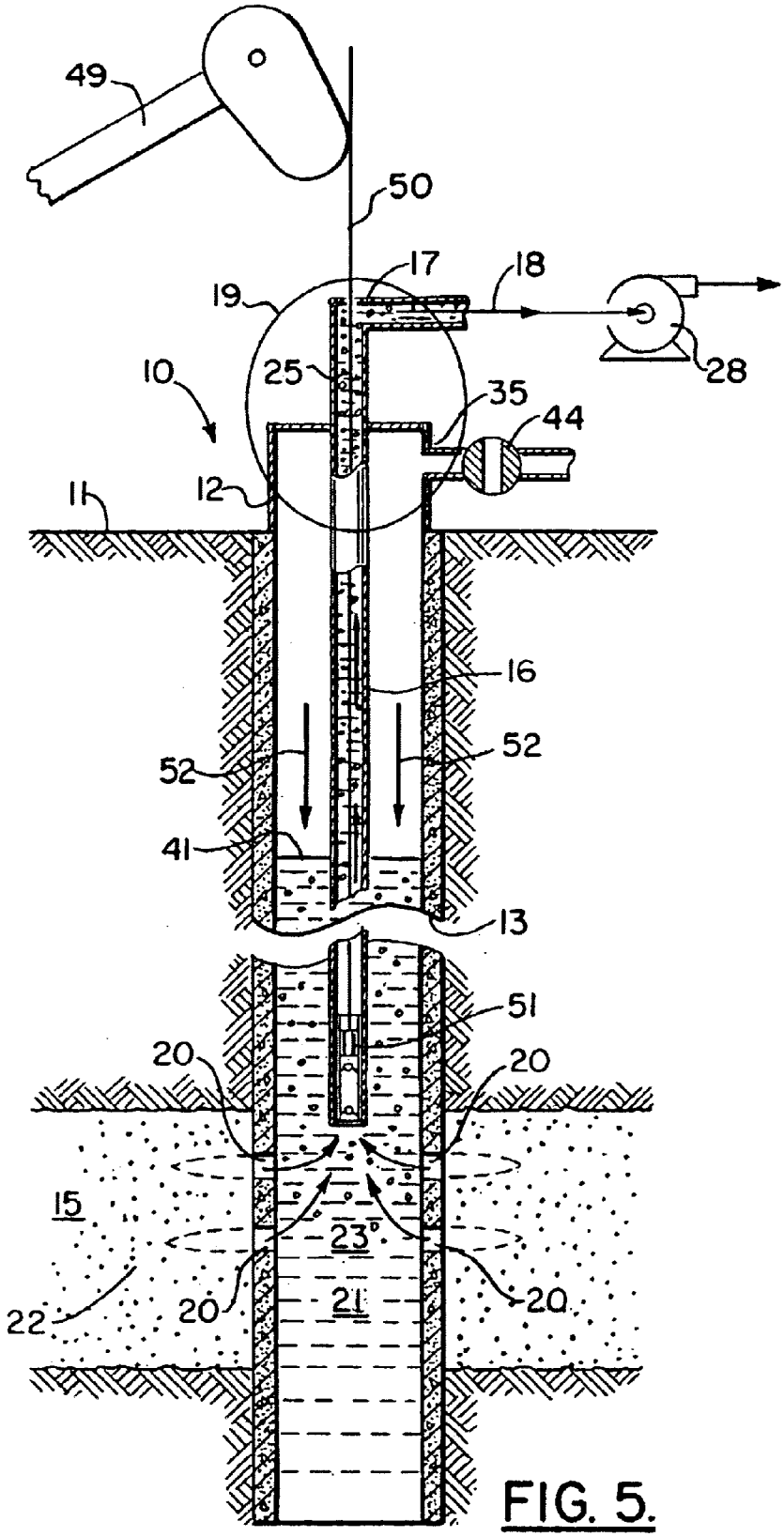
FIG. 5 is another sectional elevation view of the second embodiment of the apparatus of the present invention and showing the method of the present invention.

In the embodiment of FIGS. 4 and 5, a pressure reducing means (eg. pump 28, eductor, etc.) is applied to lateral flow line 17 attached to the production tubing 16, with some form of secondary recovery method in use as shown by balance beam (pumpjack) 49, attached to sucker rods 50. Sucker rods 50 attach to a pump 51, located inside or attached to the bottom of production pipe 16. Pressure reducing means (eg. pump 28, eductor, etc.) applied with the secondary recover methods cause reduced the pressure at the wellhead 19 (pressure point reference numeral 25), which in turn reduces the discharge pressure and the suction pressure of the pump 51), resulting in an increased production of hydrocarbons. This can also increase the efficiency of the secondary recovery method 49, and typically reduces the utility requirements for the secondary recovery method 49.

In FIG. 5, pump 28 has been applied for a period of time to lateral flow line 17 attached to the production tubing 16, and the result is that liquid level 41 in the annulus between the production pipe 16 and the casing 12 has dropped from FIG. 4 to FIG. 5 as indicated by arrows 52. This drop corresponds to fit an increase in pressure drop between production sands (pressure point reference number 22) and the inside of the well casing (pressure point reference number 23), resulting in an increased production of hydrocarbons.

PARTS LIST

PARTS LIST

| PART NO. | DESCRIPTION |
|---|---|
| 1 | well |
| 10 | well |
| 11 | earth's surface |
| 12 | well casing |
| 13 | concrete layer |
| 14 | borehole |
| 15 | production sands |
| 16 | production pipe |
| 17 | lateral flow line |
| 18 | arrow |
| 19 | wellhead |
| 20 | perforations |
| 21 | arrow |
| 22 | pressure reference point |
| 23 | pressure reference point |
| 24 | pressure reference point |
| 25 | pressure reference point |
| 26 | liquid level |
| 27 | liquid (water/oil) |
| 28 | pump |
| 35 | lateral flow line |
| 41 | liquid level |
| 44 | valve |
| 49 | balance beam (pumpjack) |
| 50 | sucker rods |
| 51 | tubing pump |
| 52 | arrows |

The foregoing embodiments are presented by way of example only; the scope of the present invention is to be limited only by the following claims.

What is claimed is:

1. A method of producing oil and/or gas from a well having a wellhead near the earth's surface, a wellbore, and an oil bearing formation surrounding the wellbore, comprising the steps of;

a) providing a wellbore that is lined with casing with a lower end above, near, or below an oil bearing formation within the earth, wherein said casing is open to the oil and/or gas bearing formation, enabling fluids to flow into said casing;

b) placing a production pipe inside the casing to provide an annulus between the casing and the pipe, the production pipe having a lower end portion that extends to an elevation that is positioned above, near, or below the oil bearing formation and an upper end that is positioned next to the wellhead;

c) enhancing the production of oil and gas via the production pipe by reducing pressure at the top of the production pipe and throughout the production pipe;

d) wherein in step "c" the pressure at the bottom of the production pipe is atmospheric pressure or above;

e) assisting in the lift of fluids from the wellbore in the production pipe with a means that is secondary to step "c"; and f) wherein said lower end portion is fully submerged during steps "c", "d", and "e".

2. The method of claim 1 wherein the secondary means includes pumping with a balance beam (pumpjack).

3. The method of claim 1 wherein the secondary means includes pumping with a downhole pump within the casing.

4. The method of claim 1 wherein the secondary means includes transmitting a surfactant or soap into the wellbore.

5. Tho method of claim 1 wherein the secondary means includes a gas lift means.

6. A method of producing oil and/or gas firm a well having a wellhead near the earth's surface, a wellbore, and an oil bearing formation within the earth that surrounds the wellbore, comprising the steps of;

a) providing a wellbore that is lined with casing having a flow bore and a lower end portion that is positioned to receive oil and/or gas flow from the oil bearing formation within the earth;

b) placing a production pipe inside the casing to provide an annulus between the casing and the production pipe, the production pipe having a bottom portion that extends to an elevation that is positioned next to the oil hearing formation and an upper end that is positioned next to the wellhead;

c) enhancing the production of oil and gas via the production pipe by reducing pressure at the top of the production pipe and throughout the production pipe;

d) wherein in step "c" the pressure at the bottom portion of the production pipe is atmospheric or above;

e) assisting in the lift of fluids from the wellbore in the production pipe and/or annulus with a means that is secondary to step "c"; and f) wherein the bottom portion of the production pipe is fully submerged during steps "c", "d", and "e" and pressure at the lower end portion is atmospheric or above.

7. The method of claim 6 wherein the secondary means includes pumping with a balance beam (pumpjack).

8. The method of claim 6 wherein the secondary means includes pumping with a downhole pump within the casing.

9. The method of claim 6 wherein the secondary means includes transmitting a soap or surfactant into the wellbore.

10. The method of claim 6 wherein the secondary means includes a gas lift means.

11. A method or producing oil and/or gas from a well, comprising the steps of;

a) providing a well bore that is drilled into tho earth for communicating with an oil bearing formation and lined with a hollow, fluid transmitting casing that extends into the earth, wherein said casing has an a flow bore, top and bottom portions, and wherein the bottom portion is positioned close enough to the oil bearing formation to enable fluids to flow into said casing from said oil bearing formation;

b) placing a production pipe inside the casing to provide an annulus between the casing and the pipe;

c) enhancing the production of oil and/or gas via the production pipe with a production enhancement that reduces pressure at the top of the production pipe and throughout at least another part of the production pipe;

d) wherein in step "c" the pressure at the bottom of the production pipe is atmospheric or above;

e) assisting in the lift of fluids from the well bore with a second production enhancement that is not the production enhancement of step "c"; and f) wherein the bottom of the production pipe is fully submerged during steps "c", "d", and "c" and pressure at the bottom of the production pipe is atmospheric or above.

12. The method of claim 11 wherein the secondary means includes pumping with a balance beam (pumpjack).

13. The method of claim 11 wherein the secondary means includes pumping with a downhole pump within the casing.

14. The method of claim 11 wherein the secondary means includes transmitting a surfactant or soap into the wellbore.

15. The method of claim 11 wherein the secondary means includes a gas lift means.

16. A method of producing oil and/or gas from a well, comprising the steps of;

a) providing a well bore that is drilled into the earth for communicating with an oil bearing formation and lined with casing that extends into the earth, wherein said casing has upper and lower end portions, and wherein the lower end portion of the casing receives flow of oil and/gas from the oil bearing formation;

b) placing a production pipe inside the casing to provide an annulus between the casing and the production pipe the production pipe having top and bottom portions;

c) enhancing the production of oil and/or gas from the well bore via the production pipe with a plurality of production enhancements, including at least one that reduces pressure at the top portion of the production pipe and throughout the production pipe;

d) wherein in step "c" the pressure at the bottom portion of the production pipe is atmospheric or above;

e) assisting in the lift of fluids from the well bore with a second production enhancement that is not the production enhancement of step "c"; and f) wherein said bottom portion is fully submerged during steps "c", "d", and "e" and pressure at the bottom portion is atmospheric or above.

17. The method of claim 16 wherein the secondary means includes pumping with a balance beam (pumpjack).

18. The method of claim 16 wherein the secondary means includes pumping with a downhole pump within the casing.

19. The method of claim 16 wherein the secondary means includes transmitting a surfactant or soap into the wellbore.

20. The method of claim 16 wherein the secondary means includes a gas lift means.

* * * * *